US009067094B2

(12) United States Patent
Chang et al.

(10) Patent No.: US 9,067,094 B2
(45) Date of Patent: Jun. 30, 2015

(54) EXERCISE APPARATUS

(71) Applicants: Ziv Chang, Taichung (TW); Joe Chen, Cottage Grove, WI (US); Noel Johnson, Stoughton, WI (US); Derek Nelson, Lake Mills, WI (US)

(72) Inventors: Ziv Chang, Taichung (TW); Joe Chen, Cottage Grove, WI (US); Noel Johnson, Stoughton, WI (US); Derek Nelson, Lake Mills, WI (US)

(73) Assignee: Johnson Health Tech Co., Ltd., Taichung (TW)

( * ) Notice: Subject to any disclaimer, the term of this patent is extended or adjusted under 35 U.S.C. 154(b) by 93 days.

(21) Appl. No.: 13/802,348

(22) Filed: Mar. 13, 2013

(65) Prior Publication Data

US 2014/0274573 A1 Sep. 18, 2014

(51) Int. Cl.

| | |
|---|---|
| ***A63B 22/04*** | (2006.01) |
| ***A63B 22/06*** | (2006.01) |
| ***A63B 69/16*** | (2006.01) |
| ***A63B 22/00*** | (2006.01) |

(52) U.S. Cl.
CPC ..... *A63B 22/001* (2013.01)

(58) Field of Classification Search
CPC ..... A63B 22/00; A63B 22/001; A63B 22/04; A63B 22/06; A63B 22/0605; A63B 22/08; A63B 22/0664
USPC ..... 482/51, 52, 57, 58–65
See application file for complete search history.

(56) References Cited

U.S. PATENT DOCUMENTS

| | | | | |
|---|---|---|---|---|
| 5,540,637 | A | 7/1996 | Rodgers, Jr. | |
| 5,743,832 | A * | 4/1998 | Sands et al. | 482/52 |
| 5,836,855 | A * | 11/1998 | Eschenbach | 482/57 |
| 6,024,676 | A * | 2/2000 | Eschenbach | 482/51 |
| 6,142,915 | A * | 11/2000 | Eschenbach | 482/52 |
| 6,672,992 | B1 * | 1/2004 | Lo et al. | 482/52 |
| 6,719,666 | B1 * | 4/2004 | Lo et al. | 482/52 |
| 6,994,657 | B1 * | 2/2006 | Eschenbach | 482/52 |
| 7,153,239 | B1 | 12/2006 | Stearns et al. | |
| 7,175,568 | B2 * | 2/2007 | Eschenbach | 482/52 |
| 7,270,626 | B2 * | 9/2007 | Porth | 482/52 |
| 7,278,955 | B2 * | 10/2007 | Giannelli et al. | 482/51 |
| 7,494,447 | B2 * | 2/2009 | Eschenbach | 482/52 |
| 7,520,839 | B2 * | 4/2009 | Rodgers, Jr. | 482/52 |
| 7,654,936 | B2 | 2/2010 | Liao et al. | |
| 7,682,290 | B2 | 3/2010 | Liao et al. | |
| 7,744,508 | B2 | 6/2010 | Liao et al. | |
| 7,841,968 | B1 * | 11/2010 | Eschenbach | 482/52 |
| 7,846,071 | B2 | 12/2010 | Fenster et al. | |
| 7,976,435 | B2 * | 7/2011 | Van Handel et al. | 482/52 |
| 8,029,416 | B2 * | 10/2011 | Eschenbach | 482/52 |
| 8,376,913 | B2 * | 2/2013 | Lee et al. | 482/52 |
| 2003/0236152 | A1 * | 12/2003 | Lo et al. | 482/52 |
| 2005/0277519 | A1 * | 12/2005 | Moon | 482/52 |
| 2007/0232457 | A1 * | 10/2007 | Porth | 482/51 |
| 2007/0238580 | A1 * | 10/2007 | Wang | 482/52 |
| 2010/0179034 | A1 * | 7/2010 | Wang | 482/110 |
| 2012/0322624 | A1 * | 12/2012 | Wu | 482/52 |
| 2013/0035212 | A1 * | 2/2013 | Chuang et al. | 482/52 |
| 2013/0143720 | A1 * | 6/2013 | Chuang et al. | 482/52 |

* cited by examiner

*Primary Examiner* — Stephen Crow
*Assistant Examiner* — Garrett Atkinson

(57) ABSTRACT

An exercise apparatus includes a frame, two crank units, two reciprocating members, two swing arms, two linkages and two carrying arms. A predetermined portion oriented between the top and bottom ends of each linkage is pivotally coupled to the corresponding crank unit and is moved along a circular path. The top end of each linkage is pivotally coupled to the corresponding reciprocating member and is moved along a curved path between two retracing points. The front end of each carrying arm is pivotally coupled to the bottom end of the corresponding linkage and is moved along a first closed path which is elliptical-like shaped. A predetermined portion oriented between the front and rear ends of each carrying arm is pivotally coupled to the bottom of the corresponding swing arm. The rear end of the carrying arm supports user's foot and is moved along a second closed path.

9 Claims, 14 Drawing Sheets

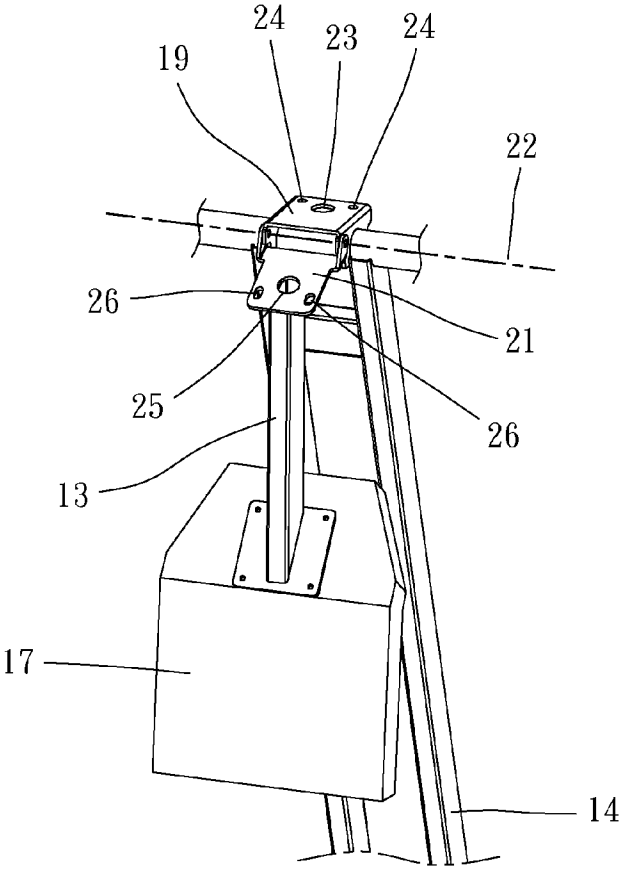
Fig. 8-B
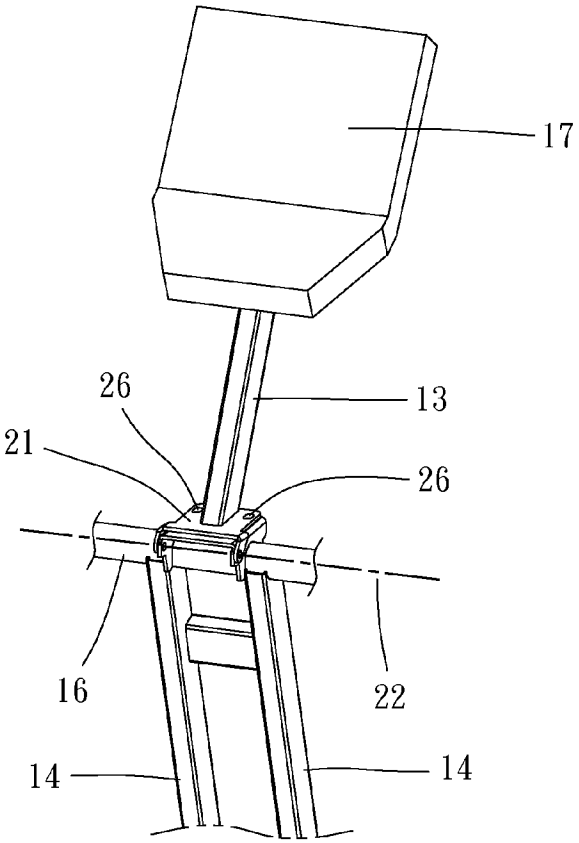
Fig. 8-A

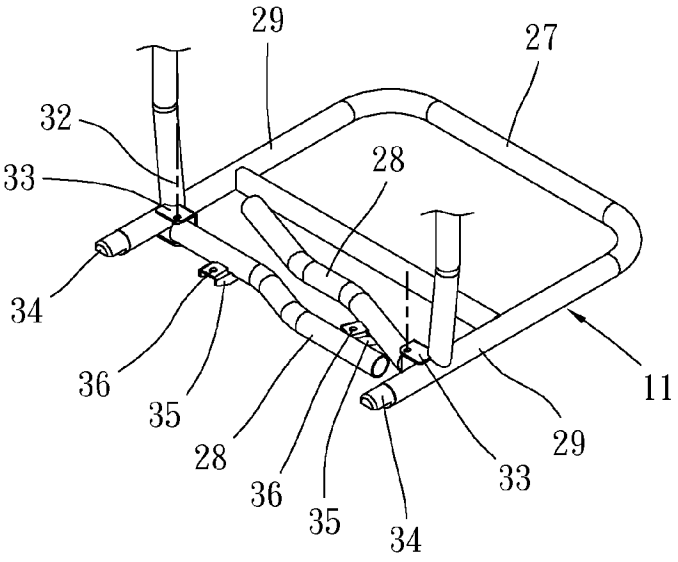
Fig. 11-B
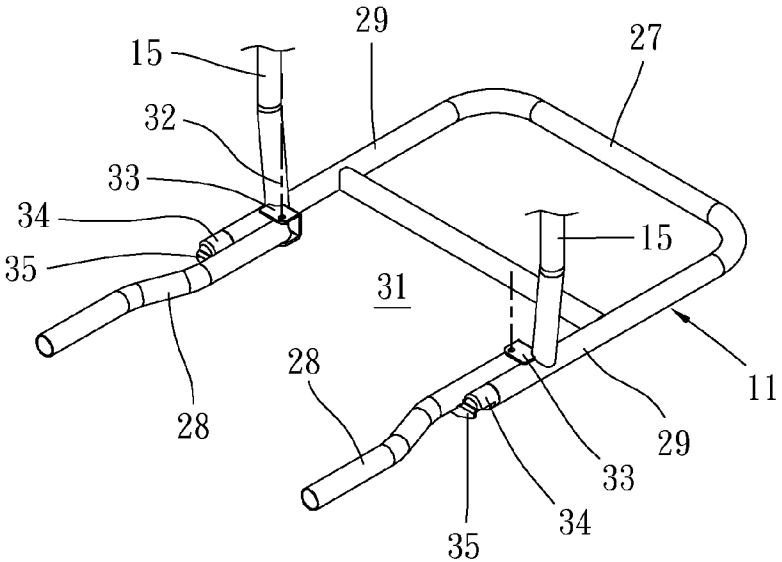
Fig. 11-A

EXERCISE APPARATUS

RELATED APPLICATIONS

The application claims priority to China Application Serial Number 201210081616.7, filed May 26, 2012.

BACKGROUND

1. Technical Field

The present disclosure relates to an exercise apparatus. More particularly, the present disclosure relates to the exercise apparatus (or called "Elliptical") which can guide user's foot to move along an elliptic closed path.

2. Description of Related Art

The "Elliptical" or "Elliptical exercise apparatus" is an exercise apparatus which can guide a user's foot to move along an elliptic closed path, such as a stationary exercise apparatus disclosed in U.S. Pat. No. 5,540,637. This kind of exercise apparatus faces the dilemma of having a longer pedal stroke or occupying a smaller footprint. For example, the longer the crank units' length of the stationary exercise apparatus is, the longer the pedal stroke (a long axis length or a front-rear direction length) is. Although the longer pedal stroke provides an adequate leg exercise for the user, the length of the stationary exercise apparatus increases so that it occupies larger space and area. On the other hand, a shorter crank units' length help save the space, but it will restrict the leg exercise. Especially in models designed for home, how to design the structure of the exercise apparatus to be more streamline and smaller under the premise of providing sufficient exercise or to provide a longer stroke of movement under the stringent limitation of volume or length has became one of the efforts in the direction of the related designer.

In addition to design the pedal path having the sufficient length, the overall shape and the dynamic of the path should conform with ergonomics in order to have the natural and comfortable leg movement. For counterexample, improper length ratio of a major axis and a minor axis of the pedal path like a too flat or round ellipse, obvious asymmetry of the closed path like an oval, the top side of the closed path forms a concave arc like meniscus, or (compare with the crank units which rotate in a constant speed) the pedals move unsteadily along the path, all of these conditions can lead the user to feel unnatural or unsmooth during exercising.

Apart from having the sufficient total length, if the angle respect to the ground of the pedal path is designed adjustable, that is, the pedal path is "inclination adjustable" or "slope adjustable", and conforms with ergonomics within the adjustment range as well, then this kind of exercise apparatus can provide an even richer and more comprehensive training for the user.

When the exercise apparatus having a sufficient space, such as U.S. Pat. No. 5,540,637, the handles design is usually not a problem, and can be very easy on designing the ergonomic handles. However, when the space is narrowed, setting the handles properly within the limited space and looking after three sides of lower-cost, easy manufactured, as well as ergonomics conformed are difficult problems. For example, an arm 140 of U.S. Pat. No. 7,153,239 is extended upward to form a handle 144. The arm 140 and the handle 144 are jointly and pivotally coupled to the inner side of the U-shaped frame. Although the foregoing mechanism is simple and easy to manufacture, it has at least two disadvantages. First, the inner side of the U-shaped frame and the upper side of a pedal 133 of an elliptical 100 are an exercising space supplied for the user obviously. If the handles are pivotally coupled to two ends of the inner side of the U-shaped frame respectively, it will directly reduce the exercising space and more likely cause inconvenient to use and non-ergonomic. On the other hand, if the width between two pivotal points of the two handles 144 meets the basic needs, it would increase the whole width of the frame. Second, the handles are unilateral pivotally coupled to the U-shaped frame. The handles are more prone to malfunction due to the unilateral force.

Moreover, the manufacturers want to reduce the storage and transportation costs of the exercise apparatus (as a variety of indoor exercise apparatuses), so that they usually disassemble the exercise apparatus into several parts and congest it into a smaller carton when packaging. After purchasing the exercise apparatus, the user must be in accordance with the guidelines of the assembly manual to build the scattered parts up to a completed exercise apparatus. In this way, the operation will be very tedious and laborious for the user.

SUMMARY

According to one embodiment of the present invention, an exercise apparatus includes a frame, an adjusting mechanism, a crank assembly, first and second reciprocating members, first and second linkages, first and second swing arms and first and second supporting arms. The frame has a fixed unit and a movable unit which is movable relative to the fixed unit. The adjusting mechanism is coupled to the frame for orienting the movable unit. The crank assembly has a pair of crank units which are respectively and pivotally coupled to the frame about a first axis. The two reciprocating members are respectively and pivotally coupled to the frame about a second axis. Each linkage has a first connecting portion, a second connecting portion and a third connecting portion. The first connecting portions are respectively and pivotally coupled to the crank units and move along a circular path about the first axis. The second connecting portions are respectively and pivotally coupled to the first and second reciprocating members and move reciprocally between a first and second retracing points of a curved path about the second axis. The second connecting portions are respectively higher than the first connecting portions. The first retracing point is higher than the second retracing point of the curved path. The third connecting portions are respectively lower than the first connecting portions. Each swing arm has a top end and a bottom end. The top ends are respectively and pivotally coupled to the frame about a third axis. Each supporting arm has a first part, a second part and a third part. The first part are respectively and pivotally coupled to the bottom ends of the first and second swing arms. The second parts are respectively arranged in front of the first parts and are pivotally coupled to the third connecting portions of the first and second linkages for moving along a first closed path. The third parts are respectively arranged behind the first parts for supporting a user's feet and are moved along a second closed path. At least one of the first axis, the second axis and the third axis is arranged on the movable unit of the frame. When the movable unit is moving, the relative position among the first axis, the second axis and the third axis and the shape or the inclination of the second closed path relative to the ground will be changed.

BRIEF DESCRIPTION OF THE DRAWINGS

The present invention will be apparent to those skilled in the art by reading the following detailed description of a preferred embodiment thereof, with reference to the attached drawings, in which:

FIG. 8-A and FIG. 8-B are enlarged fragmentary views of the vicinity of an instrument bar (without unrelated elements) and show a using state and a packaging state respectively;

FIG. 11-A and FIG. 11-B are enlarged fragmentary views of the vicinity of an bottom frame (without unrelated elements) and show the using state and the packaging state respectively;

DETAILED DESCRIPTION

Figure 1:
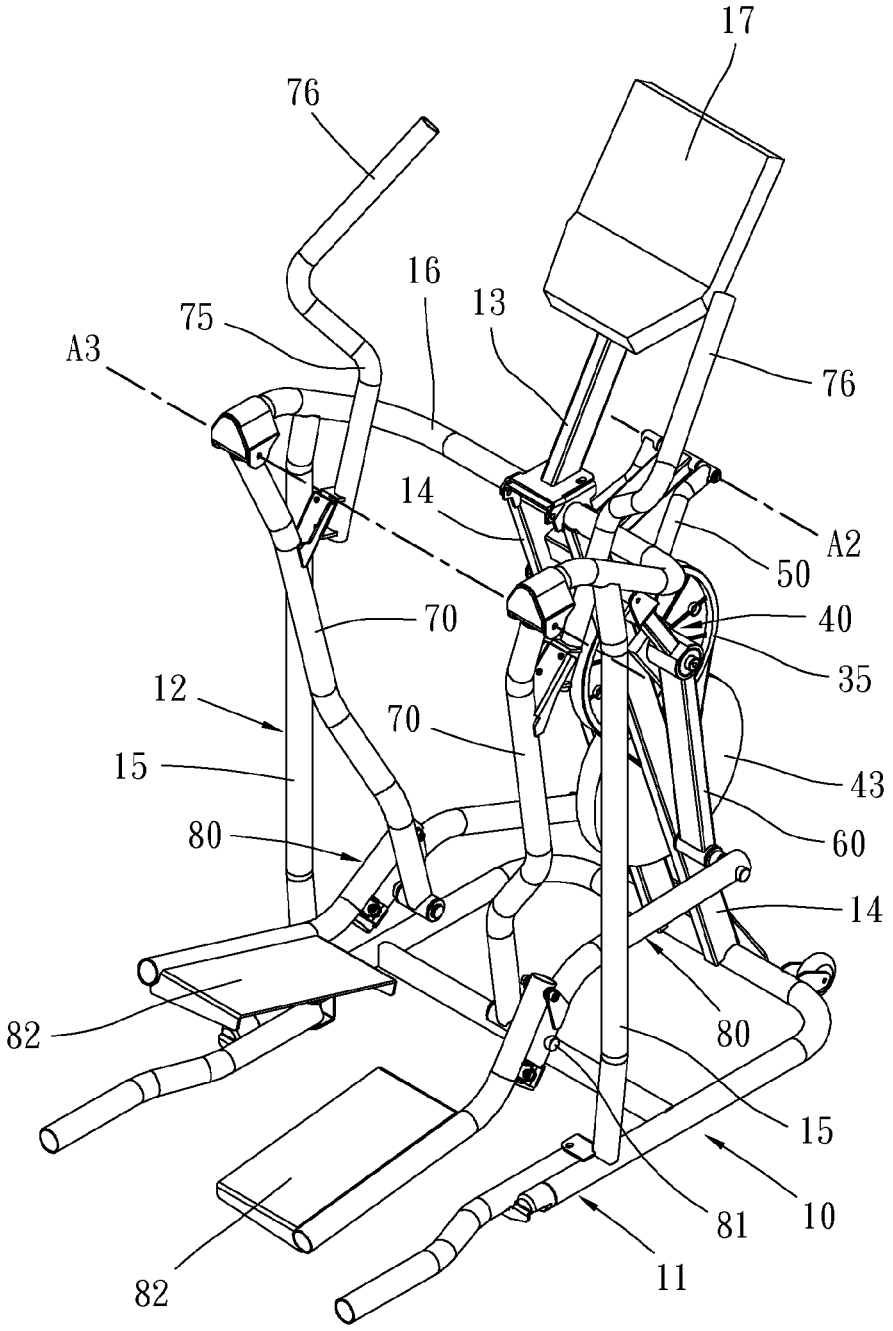
FIG. 1 is a perspective view of the right rear of an exercise apparatus according to one embodiment of the present invention.
Figure 2:
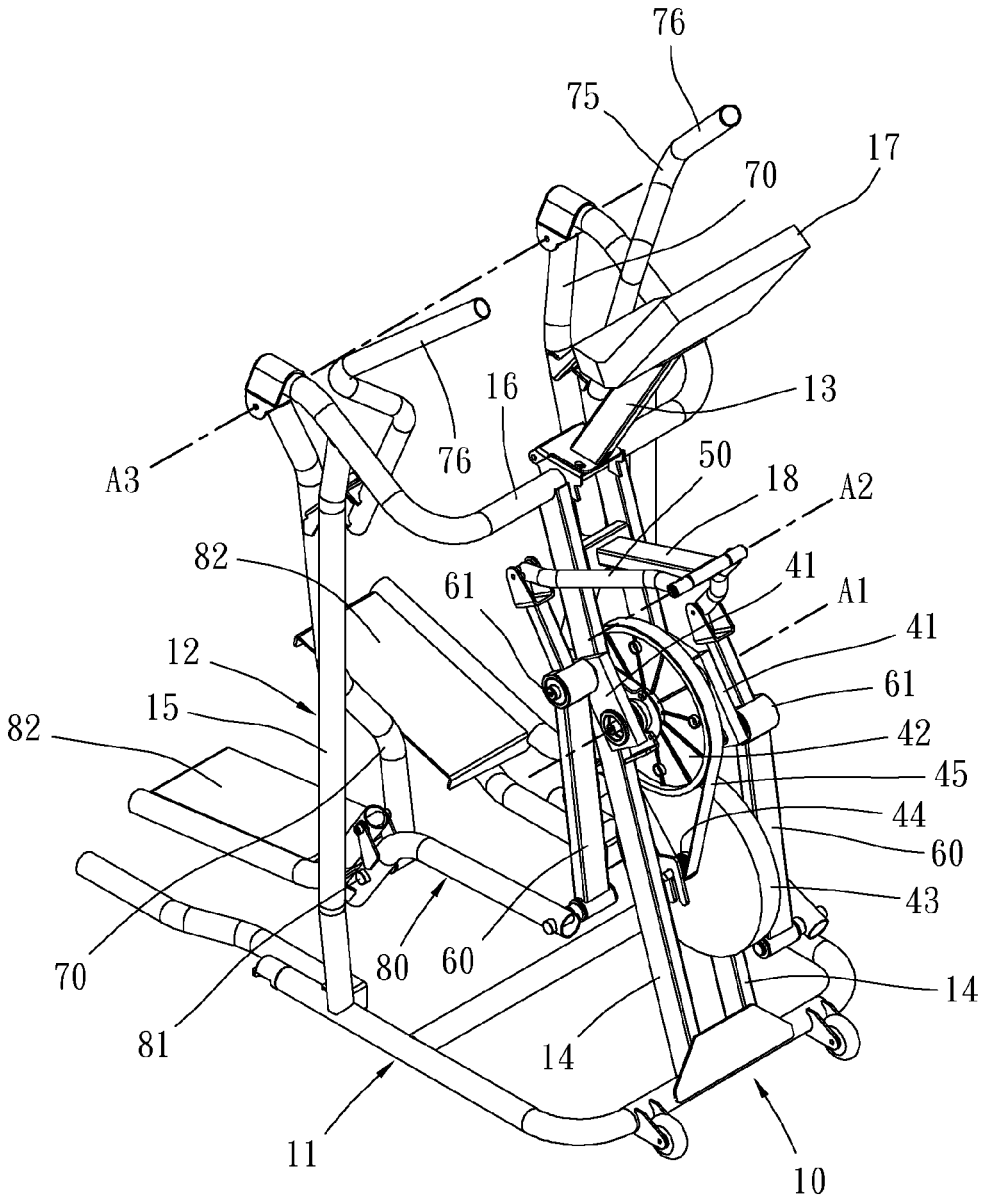
FIG. 2 is a right front perspective view of FIG. 1.
Figure 3:
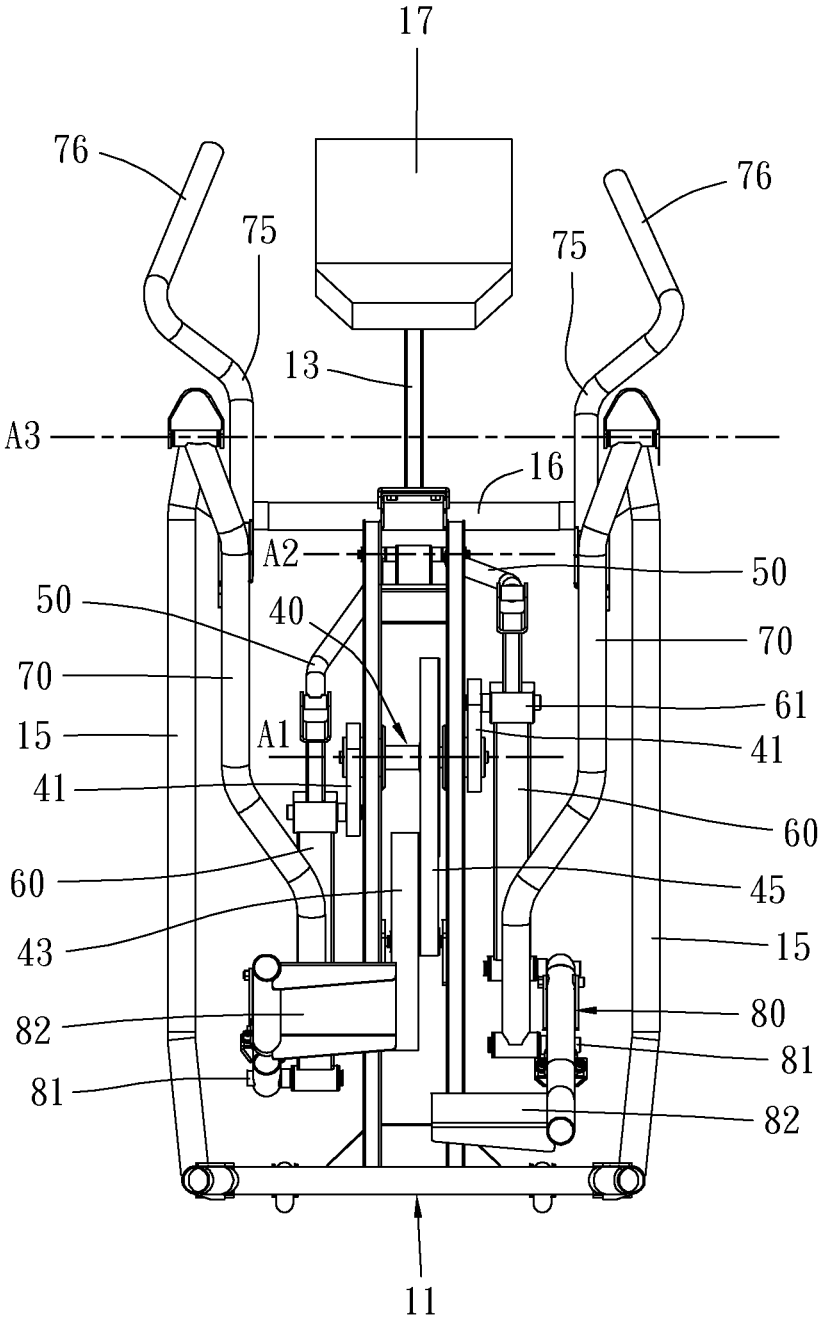
FIG. 3 is a front view of FIG. 1.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Referring to FIGS. 1-4, according to one embodiment of the present invention, an exercise apparatus has a frame 10 steadily setting on the ground. The frame 10 includes a bottom unit 11, a stand unit 12 coupled to the top of the bottom unit 11, and an instrument bar 13 coupled to the top of the stand unit 12. The stand unit 12 has two front pillar 14 which are relatively forward and parallel, two side pillar 15 which are relatively rearward and oriented at the left and right side respectively, and a U-shaped rod 16 connecting the top of the front pillar 14 and the top of the side pillar 15. An opening of the U-shaped rod 16 towards the rearward, which allows a user to intervene between the left and right side portions of the opening. The instrument rod 13 is the extension of the top of the front pillar 14 and the top end of the instrument rod 13 has a console 17.

There is a crank assembly 40 oriented at approximate meddle height of the front pillar 14 of the stand unit 12. The crank assembly 40 has a crank shaft (not numbered) which is pivotally couple to the front pillar 14 about the left and right direction and a pair of crank units 41 which are symmetrically coupled to the two ends of the crank shaft respectively. A large pulley 42 is coaxially arranged between the two cranks 41 of the crank shaft. At the same time, the bottom of the crank assembly 40 additionally has a flywheel 43 and a small pulley 44. The flywheel 43 and the small pulley 44 are coaxially coupled to each other and pivotally connected to the front pillar 14. There is a pulley-belt 45 coupled to the large pulley 42 and the small pulley 44 so that the crank assembly 40 and the flywheel 43 rotate with each other at a predetermined speed ratio. Although there is not shown in FIGS. 1-4, the present embodiment can be selectively set a resistance assembly which can provide a predetermined resistance to the flywheel 43. For example, an eddy-current brake controlled by the console 17 for providing the user to adjust the rotational resistance of the crank assembly 40 (corresponding to the degree of the user's exercising difficulty). The usage of the inertia flywheel and the resistance assembly are the generic learning prior art of this kind of exercise apparatus. Besides, the forgoing technique has no direct connection to the main feature of the present embodiment. For this reason, there is only a brief description herein.

An extending cantilever 18 is arranged near the top end of the front pillar 14 of the stand unit 12. There are two reciprocating members 50 oriented in the left and right side of the cantilever 18 respectively. The shapes of the two reciprocating member 50 are symmetrical. Each reciprocating member 50 has a first end which is relatively forward and a second end which is relatively rearward. Each first end is pivotally connected to the front end of the cantilever 18, and the pivots of the first ends of the two reciprocating members 50 are formed coaxially. The pivots form a pivot axis A2 (hereinafter referred as a second axis) parallel to a common pivot axis of the two crank units 41 (i.e., a crank axis of a crank shaft, hereinafter referred as a first axis A1). The two reciprocating members 50 can be moved relative to each other despite they have the same pivot axis.

Figure 4:
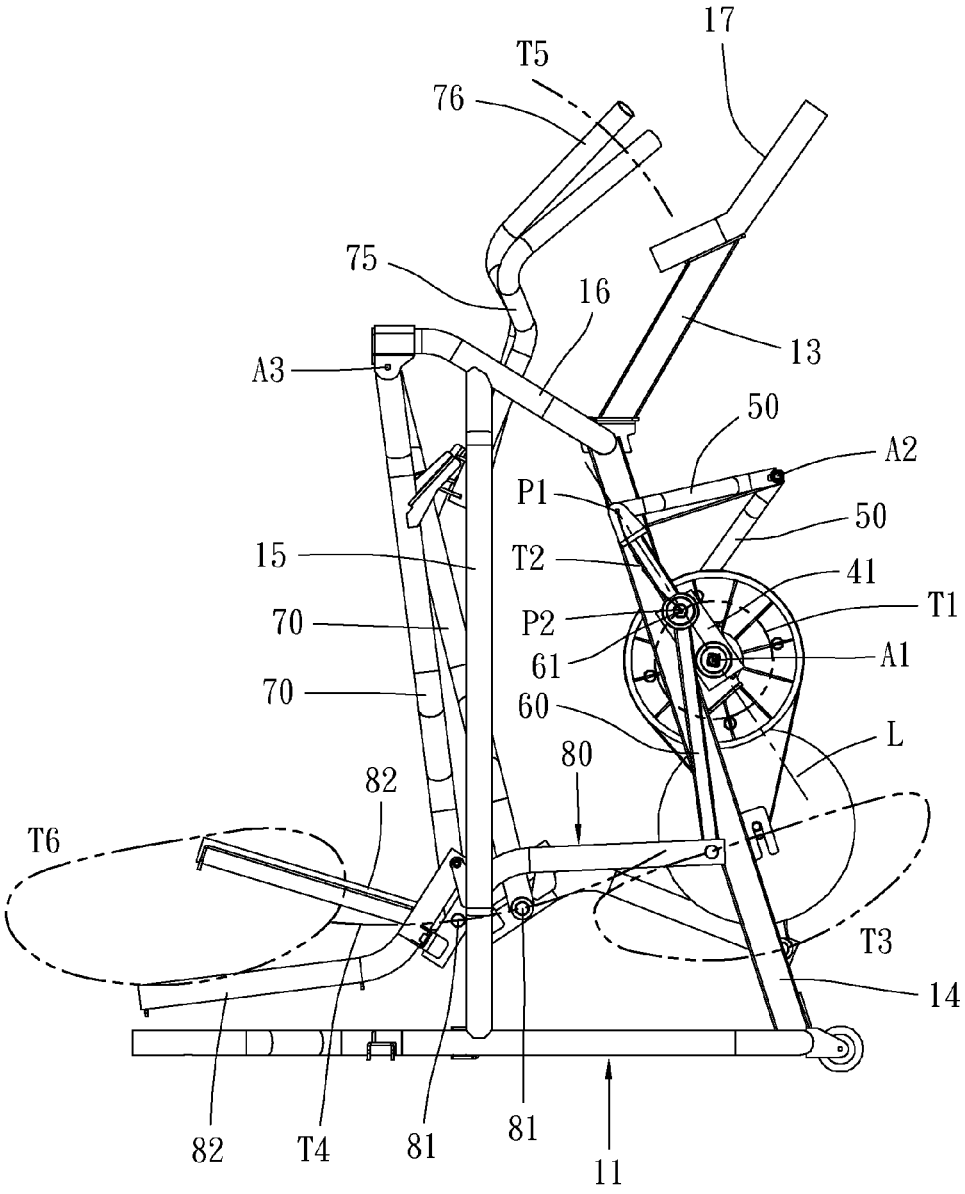
FIG. 4 is a right view of FIG. 1.

Each left and right side of the stand unit 12 of the front pillar 14 has a longitudinally extended linkage 60. A predetermined portion (hereinafter referred as a first connecting portion 61) oriented between the top end and bottom end of each linkage 60 is pivotally connected to the outer end of the relative crank unit 41. As shown in FIG. 4, the linkage 60 is restricted moving along a predetermined circular path T1 which rotates about the crank axis of the crank shaft and takes the length of the crank unit as a radius (Note: "The length of the crank unit" is defined herein as a distance between the crank axis of the crank shaft and a axis of the first connecting portion 61 in a lateral view). Due to the symmetric crank units 41, the first connecting portions 61 of the linkages 60 are 180 degrees corresponding to each other on the circular path T1 in the lateral view. The top end of each linkage 60 (hereinafter referred as a second connecting portion) is pivotally coupled to the second end of the corresponding reciprocating member 50. Because of the preset member relations (including the relative position of the first axis A1 and the second axis A2, the length of the crank unit, the length and direction of the reciprocating member 50, etc.), the first connecting portion 61 of the linkage 60 is moved along the circular path T1, the second connecting portion of the linkage 60 is moved between two endpoints (hereinafter referred as a first retracing point P1 and a second retracing point P2) and is moved along a predetermined curved path T2 about the second axis A2. Moreover, the second connecting portions of the linkages 60 is substantially moved reversely along the curved path T2 in the lateral view.

The first connecting portion 61 of the linkages 60 is moved along the circular path T1, the second connection portion is moved reciprocally along the curved path T2 simultaneously, and the bottom of the linkage 60 (hereinafter referred as a third connecting portion) is moved along a first closed path T3 which is generally elliptical-like shaped. The third connecting portion of the linkage 60 will be oriented in a substantially opposite position on the first closed path T3 in the lateral view. For example, when one of the third connecting portions is oriented in the front region of the path, the other will be oriented in the opposite rear region.

There is a longitudinally extended swing arm 70 oriented behind the bottom end of each linkage 60. The top ends of the two swing arms 70 are pivotally coupled to the both sides of the opening of the U-shaped rod 16 of the stand unit 12 respectively so that the bottom end of each swing arm 70 can be moved back and forth along a swing path T4 about a third axis A3. In addition, the near top of each swing arm 70 is connected to an upward extended rocker 75. The top of the rocker 75 is higher than the third axis A3 and is formed as a handle 76 which can be griped by the user. The handle 76 also can be moved back and forth along a swaying path T5 about the third axis A3, and be moved opposite to the bottom end of the corresponding swing arm 70.

The bottom of each swing arm 70 has a longitudinally extended carrying arm 80 which has a predetermined part (hereinafter referred as a first part 81) oriented between a front end and a rear end of the carrying arm 80. The first part 81 is pivotally connected to the bottom end of the corresponding swing arm 70 so that the first part 81 is restricted to move along the swing path T4. The front end of each carrying arm 80 (hereinafter referred as a second part) is pivotally connected to the bottom end (i.e., the third connecting portion) of the corresponding linkage 60 so that the second part is restricted to move along the first closed path T3. The second parts of the carrying arms 80 will remain in substantially opposite positions on the first closed path T3 in the lateral view. Generally speaking, the first parts 81 of the carrying arms 80 are moved reversely along the swing path T4 and the handles 76 are also moved reversely along the swaying path T5.

The inner surface of the rear region of each carrying arm 80 has a pedal 82 which is oriented at the rearward of the first part 81 to form a third part for carrying the user's foot. The front end of the carrying arms 80 (i.e., the second part) is moved along the first closed path T3 and the first part 81 is moved along the swing path T4. Combining the movements of the second part and the first part 81, the pedal 82 will be moved along a second closed path T6 which is generally elliptical-like shaped (Note: The path T6 shown in FIG. 4 is the path of the rearmost end of the pedal 82.) The two pedals 82 will remain in substantially relative position on the second closed path T6. For example, one pedal is oriented at the front region of the path, and the other one will be oriented at the opposite rear region.

The user steps on the pedals 82 and grips the handles 76 when using the exercise apparatus. The user forces to move the pedals 82 and the handles 76 appropriately along each established path, that is the two pedals 82 are moved reversely along the second closed path T6 and the two handles 76 are moved reversely along the swaying path T5. Moreover, the same side of the handle 76 and the pedal 82 are moved opposite to each other and thereby the user can have a full-body exercising. The user can obtain a smooth and stable predetermined inertia through the flywheel 43 and the resistance assembly. Besides, the user can adjust the degree of exercising difficulty according to his/her need.

Because of the structure and specific components relationship of the present embodiment, the exercise apparatus provides the sufficient pedal stroke under its smaller volume and shorter length to achieve the purpose of space saving. Meanwhile, the overall shape of the pedal path (like T6 shown in FIG. 4) as well as the pedal dynamic motion are not only ergonomics conformed but also natural and comfortable for the user. The following are the further descriptions of the present embodiment:

Referring to FIG. 4, the top end of the linkage 60 (i.e., the second connecting portion) corresponds to the curved path T2 which is longitudinally extended and oriented above the circular path T1. The circular path T1 is corresponding to the first connecting portion 61 which is oriented at the middle of the linkage 60. The bottom end of the linkage 60 (i.e., the third connecting portion) corresponds to the first closed path T3 which is oriented below the circular path T1 and substantially rendered as an ellipse. The length of a minor axis of the first closed path T3 is approximately equal to a diameter of the circular path T1. The length of a major axis of the first closed path T3 is significantly greater than the diameter of the circular path T1. The length of the major axis of the first closed path T3 is approximately three times greater than the diameter of the circular path T1 in the present embodiment. The magnification mainly depends on a ratio of an lower length (a distance between the first connecting portion 61 and the third connecting portion) and an upper length (a distance between the first connecting portion 61 and the second connecting portion) of the linkage 60 in a lateral view. In other words, the longer the lower length of the linkage 60 is, the longer the major axis of the first closed path T3 is. If the lower length is too long, the top side of the first closed path T3 forms a concave arc, and it will not conform with ergonomics. Therefore, the ratio should be controlled within a proper range. For example, the lower length is greater than the upper length of the linkage 60, and it is also greater than the diameter of the circular path T1. However, the lower length of the linkage 60 is not greater than three times of the diameter.

The first part 81 which is oriented at the middle of the carrying arm 80 corresponds to the swing path T4. The swing path T4 is longitudinally extended and is oriented behind the first closed path T1 which corresponds to the front end of the carrying arm 80 (i.e., the second part) so that the pedal 82 can be moved along the second closed path T6 which is substantially rendered as an ellipse as well. The major axis of the second closed path T6 is substantially equal to the major axis of the first closed path T3. In other words, the stroke of the pedal 82 is about three times the diameter of the circular path T1 in the present embodiment. Comparing to heretofore known exercise apparatus (e.g., the structure of U.S. Pat. No. 5,540,637), the pedal stroke is usually equal to the diameter of the circular path. The present embodiment provides the same pedal stroke through the shorter crank unit. The length of the crank unit determines the total length of the exercise apparatus, so the present embodiment can provide a shorter length of the exercise apparatus and saving space.

Incidentally, if the position of the curved path T2 and the circular path T1 is reversed, that is if the top end of the linkage 60 is restrictedly moved along a circular path, a predetermined portion between the top end and the bottom end of the linkage 60 will be restrictedly moved along a longitudinal path at the same time. Although the bottom end of the linkage 60 is corresponding moved along a closed path, the amplification effect of the length of the major axis of the closed path is worse than the amplification effect of the length of the crank unit, and the shape of the path is similar to a semicircle rather than an ellipse so that this kind of arrangement is not practical.

The curved path T2 is close to the top rear of the circular path T1 in the present embodiment and the first retracing point P1 of the curved path T2 is oriented at the top rear of the second retracing point P2. The first retracing point P1 is higher than the second retracing point P2. The first retracing point P1 and the second retracing point P2 define a straight line L which is down through the circular path T1. The better condition is that the straight line L passes through the center of the circular path T1 as shown in FIG. 4. The straight line L (representing the direction of the reciprocated movement of the linkage 60) of the present embodiment passes through the circular path T1, or even passes through its center so that the shape of the two halves of the first closed path T3 are more symmetrical and the shape of the second closed path T6 is corresponding more symmetrical, too. For example, there is less likely to have an oval path which has one rounded end and the other pointed end.

The straight line L is preset tilt rather than perpendicular to the ground in order that the major axis of the first closed path T3 has a predetermined elevation angle (which means the front end is appropriately higher than the rear end) respect to the ground. As a result, the second closed path T6 has a corresponding shape to adapt to user's leg movement. Furthermore, as shown in FIG. 4, in order to tilt the first closed path T3 and not to increase the total length of the exercise apparatus due to the position shaft of the first closed path T3, the bottom end of the linkage 60 (i.e., the third connecting portion) is oriented at the rearward of an extension line (not shown) which is passing from the top end (i.e., the second connecting portion) to the first connecting portion 61 in the present embodiment.

The exercise apparatus of the present embodiment has a space-saving feature in a using state as described. The following will describe a packaging state of the exercise apparatus when it is leaving the factory, and the user's assembling work after purchasing the exercise apparatus.

Figure 5:
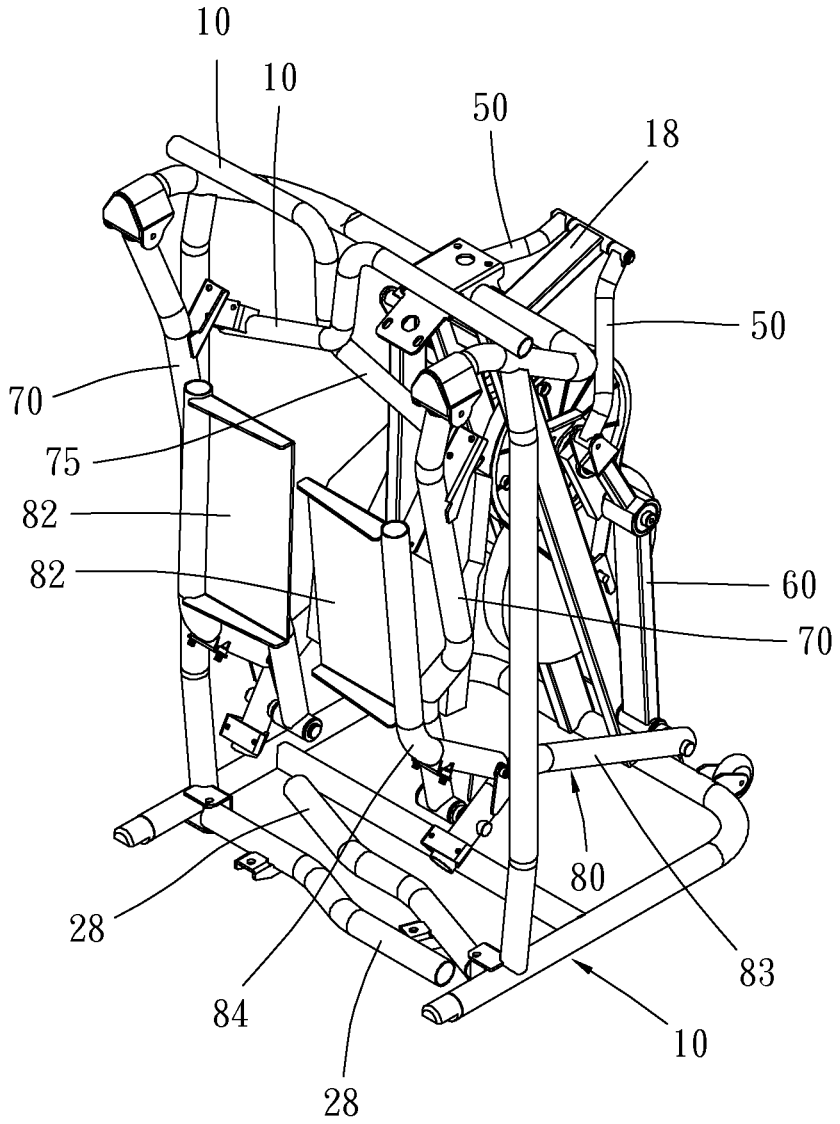
FIG. 5 is a right rear perspective view of the packaged exercise apparatus.
Figure 6:
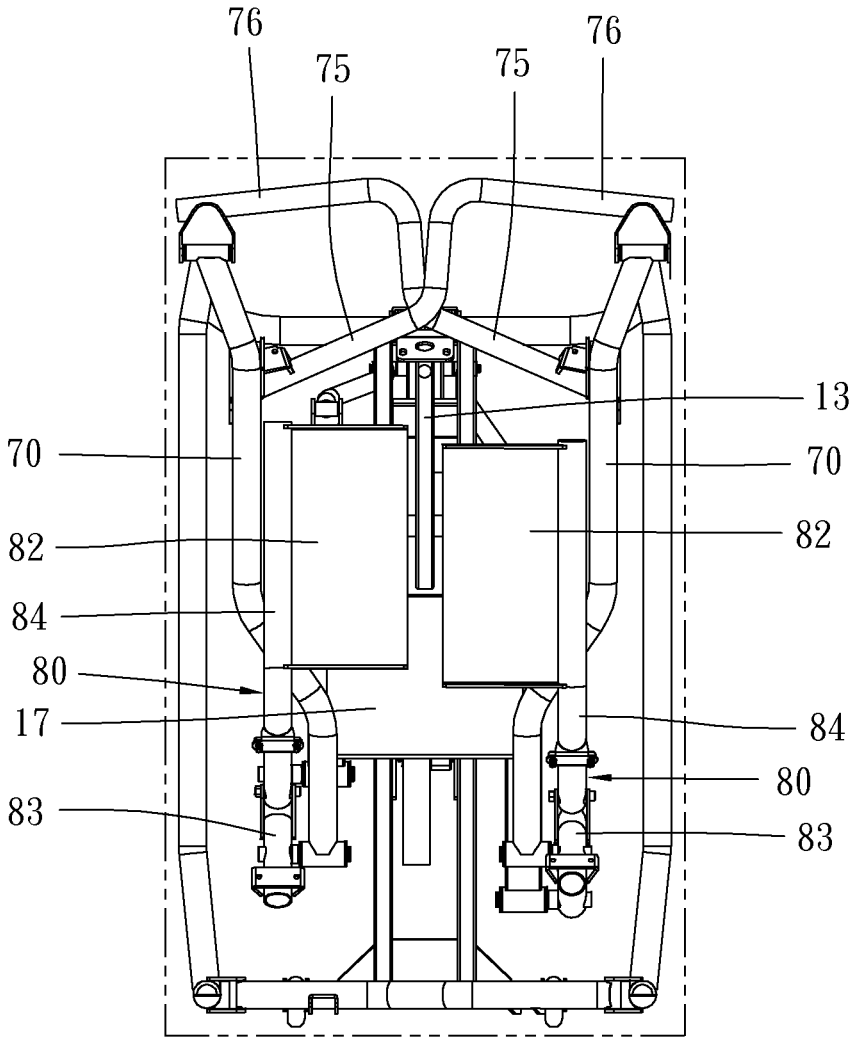
FIG. 6 is a front view of FIG. 5.
Figure 7:
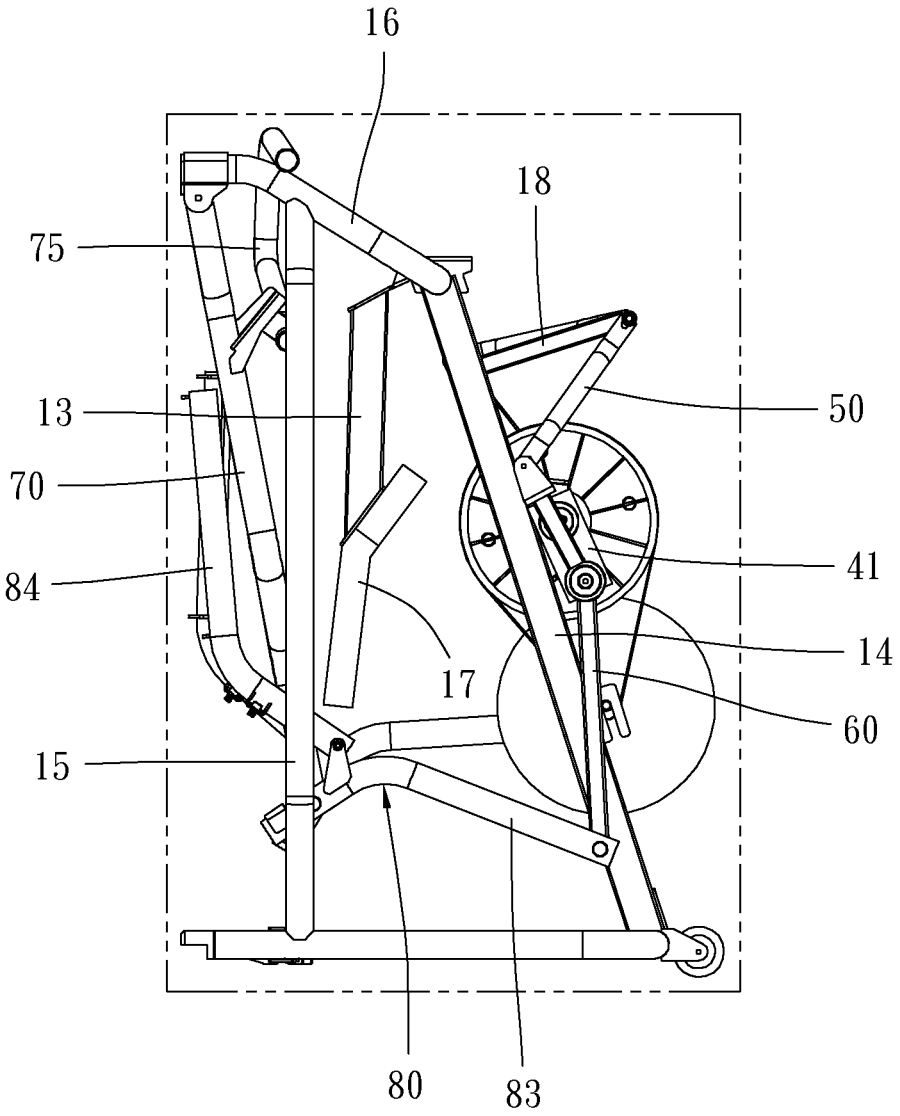
FIG. 7 is a right view of FIG. 5.

Referring to FIGS. 5-7 which are shown a constriction structure of the packaged exercise apparatus. Comparing FIGS. 6-7 (Note: The rectangular border shows the carton size) with FIGS. 3-4 respectively, the height and the length of the packaged exercise apparatus are significantly less than the height and the length of the exercise apparatus in the using state. The packaged exercise apparatus not only renders as a high density structure but also effectively saves packaging materials, storing fees, and shipping costs. In order to facilitate the assembly operations for the user after purchasing the exercise apparatus. The exercise apparatus is not using the conventional packaging skills which is disassembling the exercise apparatus into several components, but uses some proper folded structures for temporarily folding the exercise apparatus into the packaging state (or not assembling into the using state) before the exercise apparatus leaves the factory. Before using the exercise apparatus for the first time, the user then unfolding and locking it into the using state. The following four parts of the folded structures include the instrument bar 13, the rocker 75, the carrying arm 80, and the bottom unit 11 of the frame 10 will be described sequentially.

Referring to FIG. 8-A and FIG. 8-B, the instrument bar 13 is pivotally coupled to the stand unit 12 by a releasable or a lockable manner. In more details, a carrying seat 19 is arranged on a intersection of the front pillar 14 of the stand unit 12 and the U-shaped rod 16. A joint seat is arranged on one end of the instrument bar 13 (i.e. the bottom end when using) which is away from the console. The front edge of the joint seat is pivotally coupled to the front edge of the carrying seat 19 of the stand unit 12 via a lateral pivot shaft 22 so that the instrument bar 13 can be folded downward from FIG. 8-A to FIG. 8-B. The folded instrument bar 13 is positioned between the two side pillars 15 as shown in FIGS. 5-7. The carrying seat 19 of the stand unit 12 has a wiring hole 23 and a screw hole 24, and the joint seat 21 of the instrument bar 13 has a wiring hole 25 and a perforation 26. The wiring hole 23 and the screw hole 24 are corresponding to the wiring hole 25 and the perforation 26 respectively. When doing the assembly operations, the user unfolds the instrument bar 13 to connect the joint seat 21, and then a bolt (not shown) locks through the perforation 26 to the screw hole 24. As a result, the instrument bar 13 will be locked in a predetermined position which is free to use. The wiring holes 23, 25 have wires (not shown) which are electrically connected to the console 17 and the resistance assembly. According to the different designs, the user may or may not be required to set the wires before assembling the instrument bar 13.

Figure 9:
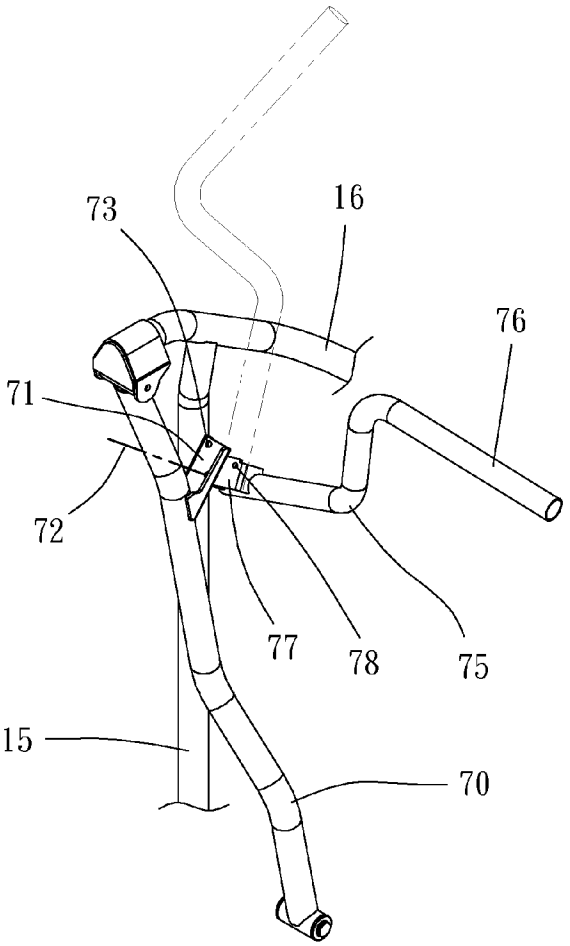
FIG. 9 is an enlarged fragmentary view of the vicinity of a swing arm and a rocker (without unrelated elements) and shows the packaging state.

Referring to FIG. 9 (Note: It shows a fragmentary structure of the lift side of the exercise apparatus), each rocker 75 is pivotally coupled to the corresponding swing arm 70 by a releasable or a lockable manner. In more details, a carrying seat 71 is coupled to close to the top end of each swing arm 70. A joint seat 77 is relatively coupled to one end of each rocker 75 (i.e. the bottom end of the rocker 75 when using) which is away from the handle 76. The carrying seat 71 is pivotally and parallely connected to the joint seat 77 via a diagonal pivot shaft 72 which is extended from the rear top to the front bottom, so that each rocker 75 is extended from the upward to the other side (e.g., the left rocker is extended to the right side as shown in FIG. 9) and is substantially positioned in an area enclosed by the U-shaped rod 16 as shown in FIGS. 5-7. The carrying seat 71 of each swing arm 70 has a perforation 73, and the joint seat 77 of each rocker 75 has a screw holes 78 which is corresponding to the perforation 73. When doing the assembly operations, the user unfolds the rocker 75 to connect the swing arm 70, which means the screw holes 78 will correspond to the perforation 73, and then a bolt (not shown) locks through the perforation 73 to the screw hole 78. As a result, the rocker 75 will be relatively locked to the swing arm 70 in a predetermined position which is free to use.

Figure 10:
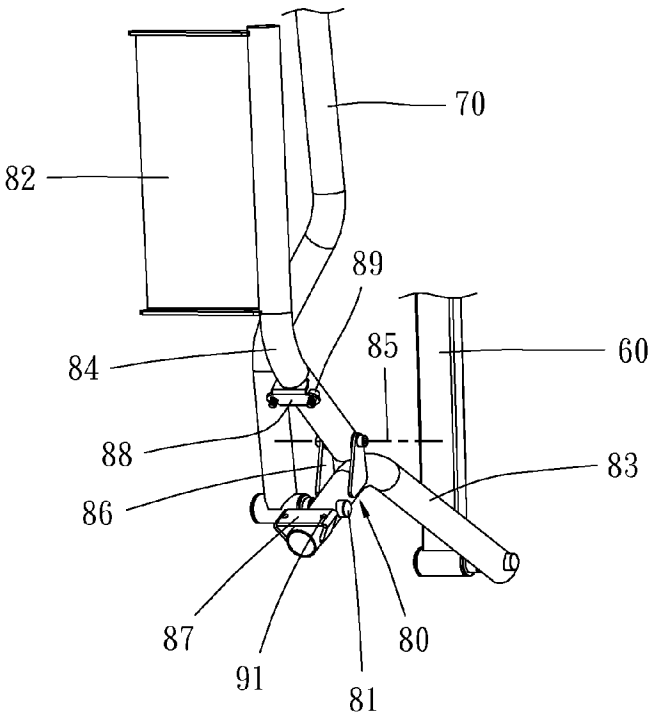
FIG. 10 is an enlarged fragmentary view of the vicinity of a carrying arm (without unrelated elements) and shows the packaging state.

Referring to FIG. 10 (Note: It shows a fragmentary structure of the right side of the exercise apparatus), each carrying arm 80 comprises a front bar 83 and a rear bar 84. Each front bar 83 is pivotally connected to the corresponding rear bar 84 by a releasable or a lockable manner. In more details, the front end of the front bar 83 is pivotally coupled to the bottom end of the swing arm 70 to form a first part 81, and the rear end of the front bar 83 is pivotally coupled to the bottom end of the linkage 60 to form a second part. The rear half of the rear bar 84 is formed a third part which is carrying the user's foot, and the front end of the rear bar 84 is pivotally coupled to a bracket 86 which is oriented close to the rear end of the front bar 83 via a lateral pivot shaft 85. Therefore, the rear bar 84 of the carrying arm 80 can be extended from the backward to the upward, as shown in FIGS. 5-7 and FIG. 10. The rear top of each front bar 83 has a carrying seat 87, and the front bottom of each rear bar 84 has a joint seat 88 which is corresponding to the carrying seat 87. When doing the assembly operations, the user unfolds the rear bar 84 to connect the front bar 83, which means the joint seat 88 will correspond to the carrying seat 87, and then a bolt 89 locks through the joint seat 88 to the screw hole 91 of the carrying seat 87. As a result, the carrying arm 80 will be locked as the using state.

Referring to FIG. 11-A and FIG. 11-B, the bottom unit 11 comprises a fixed frame 27 and two folded rods 28 which are pivotally coupled to the rear end of the fixed frame 27 by a releasable or a lockable manner. In more details, the fixed frame 27 is the connective base of the stand unit 12 and has two parallel side rods 29. The rear half of the two side rods 29 form a storage space and an opening of the two side rods 29 toward the rearward. One end of each folded bar 28 (i.e. the front end of the folded bar when using) is pivotally connected to a bracket 33 which is oriented close to the rear end of the corresponding side rod 29 via a vertical pivot shaft 32. In this way, each folded bar 28 is extended from the backward as shown in FIG. 11-A to the other side as shown in FIG. 11-B and it is positioned in the storage space 31 of the fixed frame 27. The rear end of each side rod 29 has a downward embedded seat 34 and each folded bar 28 has a corresponding upward embedded seat 35. When doing the assembly operations, the user unfolds the side rod 29 to connect the fixed frame 27, which means the upward embedded seat 35 will correspond to the downward embedded seat 34 and a post (not shown) which is oriented at the bottom of the downward embedded seat 34 engages with a recess 36 which is oriented at the upward embedded seat 35. Therefore, the folded bar 28 will be located at a predetermined position for expanding the supporting area of the bottom of the frame 10. A circular pivot hole is arranged on the bottom end of the bracket 33 and an elliptical pivot hole is arranged on the top end of the bracket 33. The vertical pivot shaft 32 passes through the circular pivot hole and the elliptical pivot hole. The folded bar 28 is pivotally coupled to the bracket 33 via the vertical pivot shaft 32. When the user unfolds the folded bar 28 close to the using state, the user can force the upward embedded seat 35 to skip the post of the downward embedded seat 34 (or slightly elevate the fixed frame 27 if necessary), then the recess 36 can engage with the post.

To sum up, after unpacking the packaging carton (and possibly some positioning materials) of the exercise apparatus, the user can sequentially unfold the two folded rods 28 of the bottom unit 11, the rear bars 84 of the two carrying arms 80, the two rockers 75, and the instrument bar 13 back to their foregoing predetermined positions, and assembles the exercise apparatus rapidly and simply from the packaging state to the using state. If necessary, for example, when the exercise apparatus is not using, storing or transferring, the user may also fold it into the packaging state.

The following descriptions are the exercise apparatus according to another embodiment of the present invention. The general structure of this embodiment is the same as the foregoing described embodiment, in order to avoid being lengthy, there are solely detailing the differences.

Figure 12:
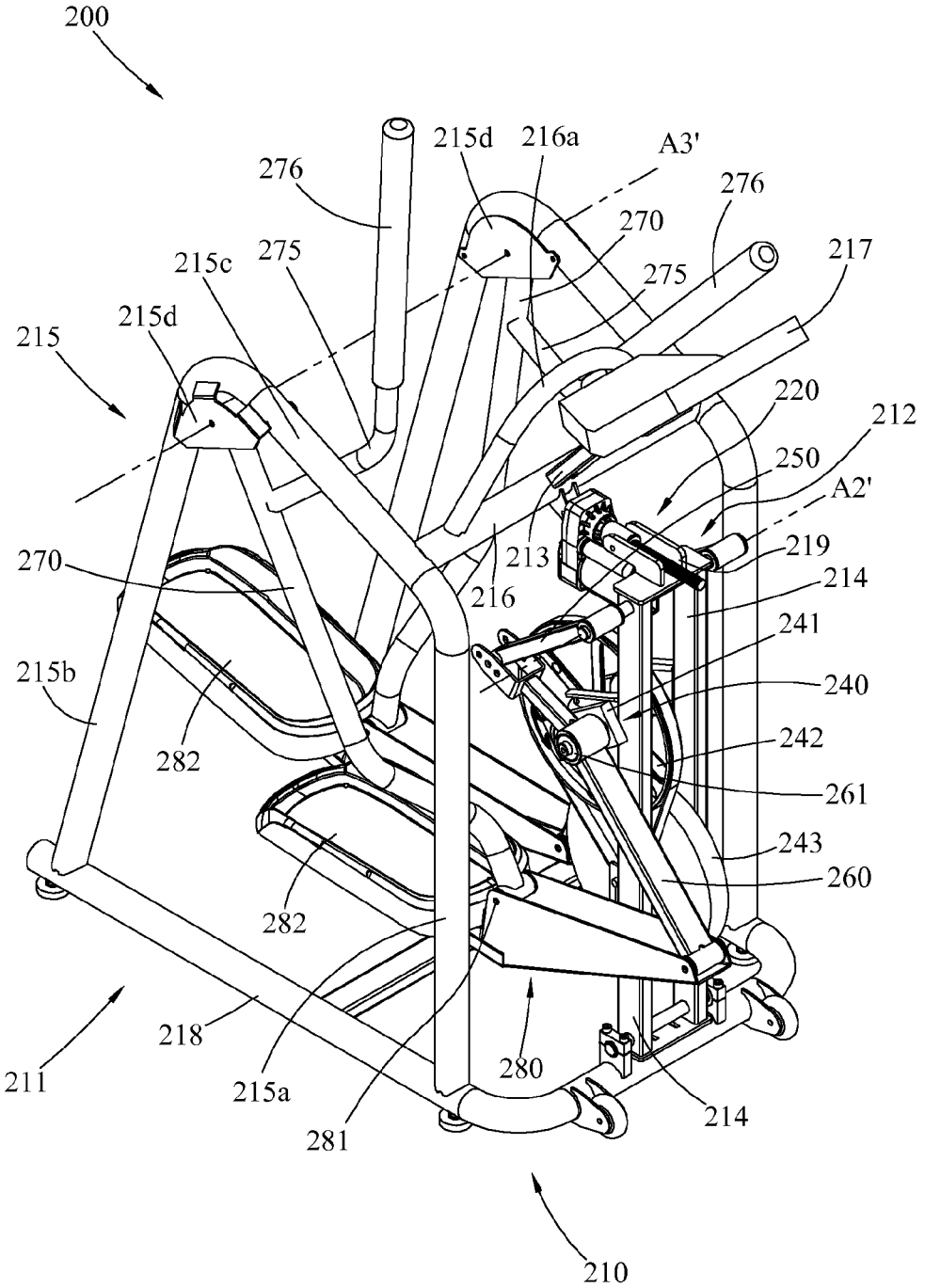
FIG. 12 is a perspective view of an exercise apparatus according to another embodiment of the present invention.
Figure 13:
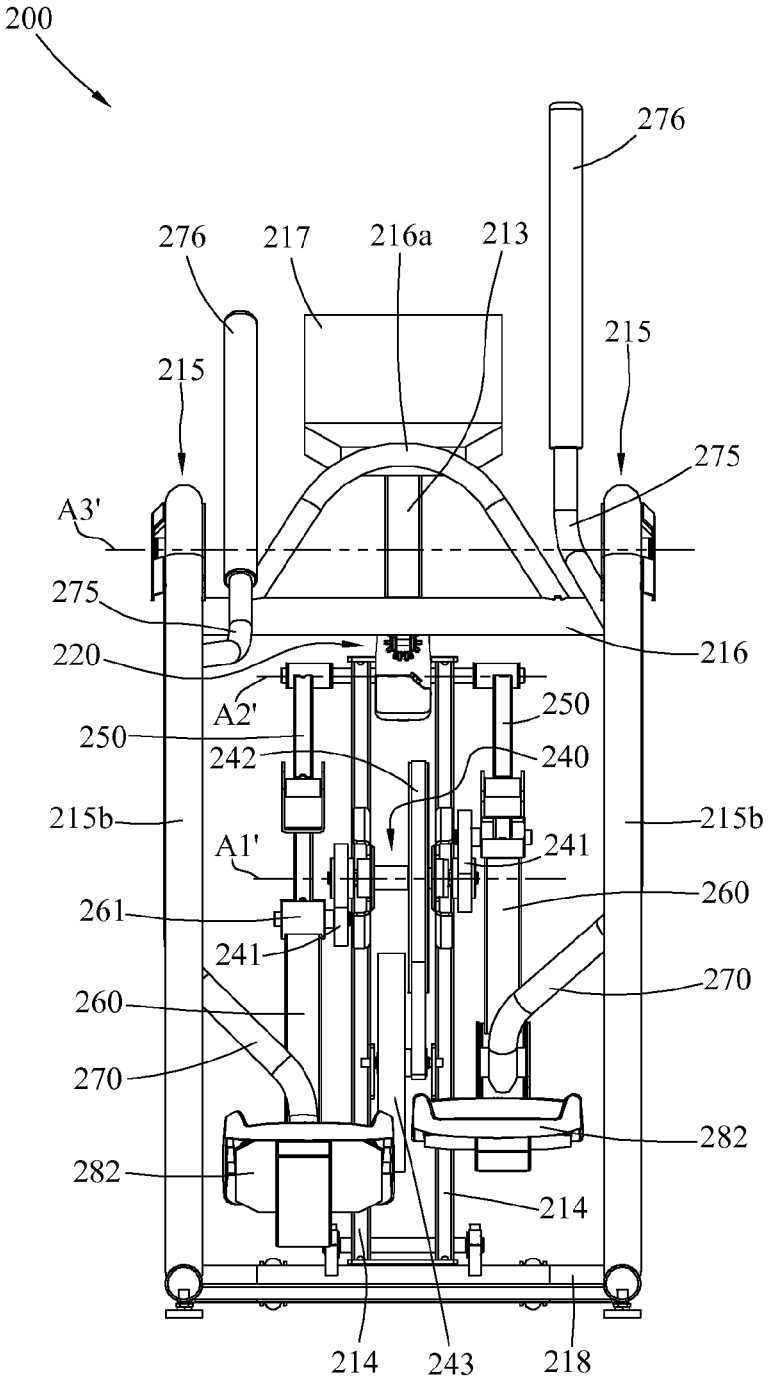
FIG. 13 is a front view of FIG. 12.
Figure 14:
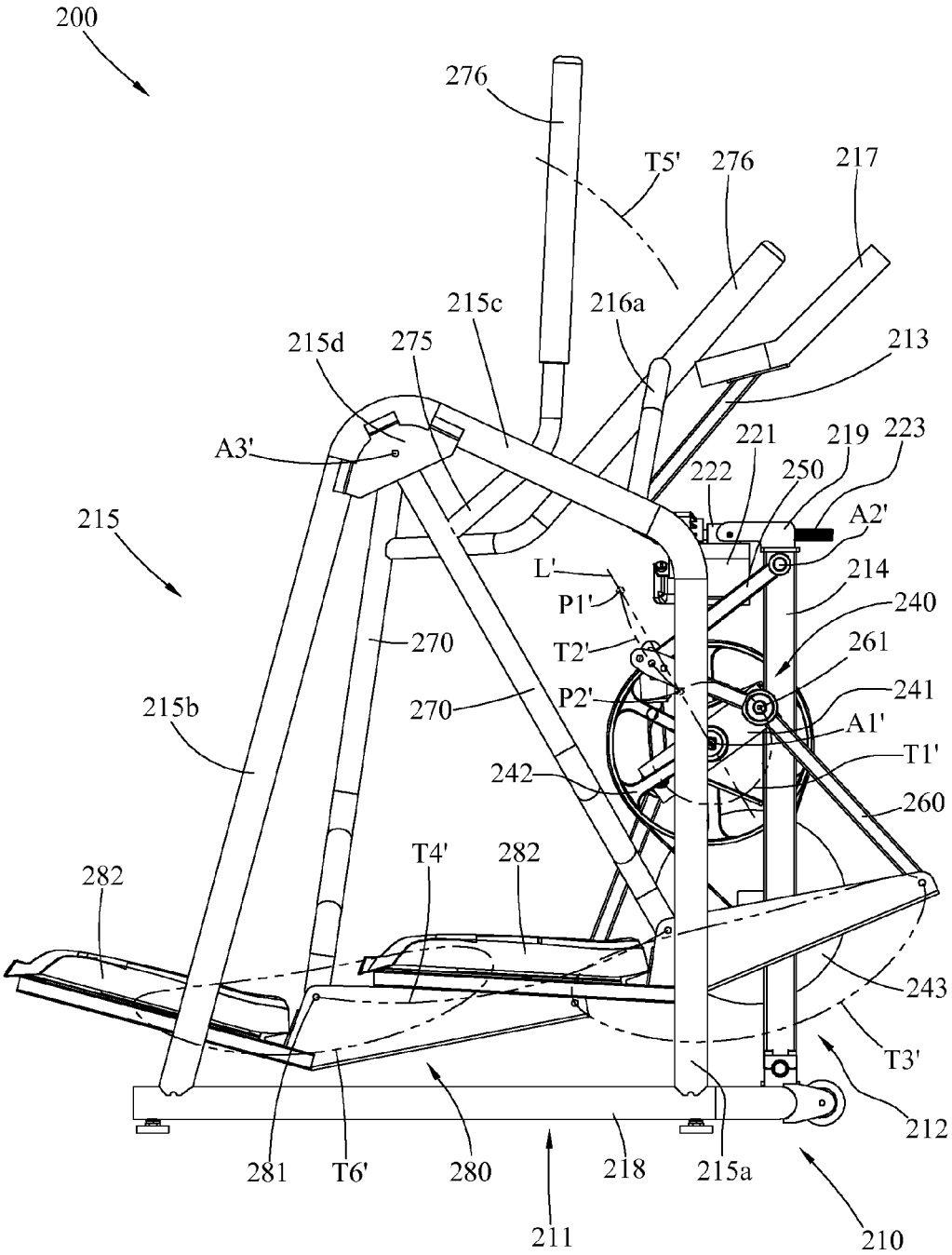
FIG. 14 is a right view of FIG. 12.

Referring to FIGS. 12-14, according to another embodiment of the present invention, an exercise apparatus 200 has a frame 210 which comprises a fixed unit 211 and a movable unit 212. The fixed unit 211 includes a bottom unit 218 setting on the ground, two stand units 215 coupled to the top end of the bottom unit 218, a cross bar 216 coupled between the two stand units 215 and an instrument bar 213 coupled to the cross bar 216. The two stand units 215 are symmetrically and respectively formed in invert U-shape. Each stand unit 215 has a front bar 215*a*, a rear bar 215*b* and a cross bar 215*c* which is connected between the front bar 215*a* and the rear bar 215*b*. Besides, two fixed plates 215*d* are arranged below the junction of the rear bar 215*b* and the cross bar 215*c* of the stand unit 215. The two stand units 215 and the cross bar 216 define an exercising space which allows the user to enter from the rear. On the other hand, a fixed armrest 216*a* is arranged on the cross bar 216 and a console 217 is arranged on the top end of the instrument rod 213 which is in front of the fixed armrest 216*a*. The movable unit 212 includes two parallel front pillars 214 oriented between the two front bars 215*a*. The top ends of the two front pillars 214 are connected to a connector 219, and the bottom ends of the two front pillars 214 are pivotally connected to the bottom unit 218 of the fixed unit 211 via a lateral pivot shaft, so that the front pillars 214 can be rotated forward or backward relative to the fixed unit 211.

Figure 15:
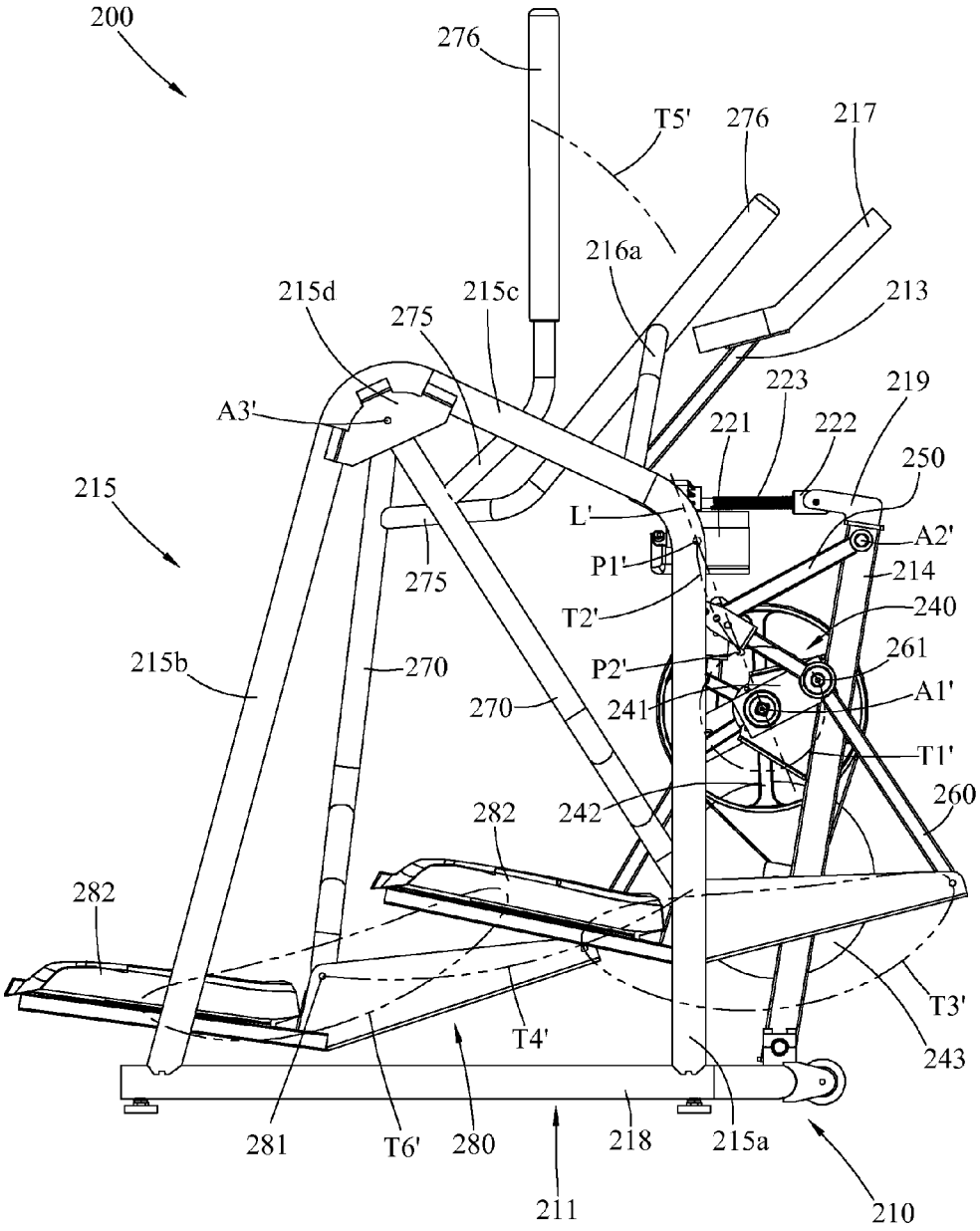
FIG. 15 is a right view of FIG. 12 when the movable unit is inclined.

There is an adjusting mechanism 220 arranged between the connector 219 of the front pillar 214 and the cross bar 213 of the fixed unit 211. The adjusting mechanism 220 includes a motor assembly 221, a screw 223 and a nut 222. The rear end of the motor assembly 221 is coupled to the cross bar 216 of the fixed unit 211. One end of the screw 223 is extended longitudinally and pivotally coupled to the motor assembly 221. The nut 222 is pivotally connected to the connector 219 of the top end of the front pillar 214 and is passed through by the screw 223. The screw 223 can be rotated forward or reversely about its axis by the motor assembly 221, so that the nut 222 can be moved along the screw relative to the ground. As a result, the two front pillars 214 can be moved forward or backward about its bottom pivot shaft and can be located at a predetermined position within a scope. The scope is defined between a position of the front pillar 214 (hereinafter referred as a first position) as shown in FIG. 14 and a position of the front pillar 214 (hereinafter referred as a second position) as shown in FIG. 15 in the present embodiment. In more details, the adjusting mechanism 220 can be located at the first position, the second position or between two of them.

The crank assembly 240 is arranged on an approximate middle position of the front pillar 214 of the movable unit 212. The crank assembly 240 has two crank units 241 and a crank shaft (not numbered). The crank shaft is pivotally coupled to the front pillar 214 about a first axis A1' and the two crank units 241 are coupled to the two end of the crank shaft respectively. When the front pillar 214 is rotated by the adjusting mechanism 220, the crank assembly 220 is moved relative to the fixed unit 211 simultaneously. In addition, the bottom of the crank assembly 240 has a flywheel 243 which can provide inertial and resistance coordinating with the resistance assembly (not shown).

The top ends of the two front pillars 214 have two rod-like reciprocating members 250 respectively. The difference between the present embodiment and the foregoing embodiment is that the two reciprocating members 250 are pivotally coupled to the two sides of the movable unit 212 about a second axis A2' which is moved with the movable unit 212 of the frame 210. Please referring to the described embodiment for other details about the reciprocating members 250.

Two longitudinally extended linkages 260 are oriented at the outer sides of the two front pillars 214 respectively. The connection between each linkages 260 and the peripheral structure is the same with the foregoing embodiment. A first connecting portion 261 of the linkage 260 is moved along a circular path T1' and the top end of the linkage 260, a second connecting portion, is moved along a predetermined curved path T2' about the second axis A2'. The curved path T2' has two retracing points (hereinafter referred as a first retracing point P1' and a second retracing point P2') and the second connecting portion is moved between the two retracing points. The two second connecting portions of the two linkages 260 are moved reversely along the curved path T2' in the lateral view.

Combining the movements of the first connecting portion 261 which is moved along the circular path T1' and the second connecting portion which is moved along the curved path T2', the bottom end of the linkage 260 (hereinafter referred as a third connecting portion) will be moved along a first closed path T3' which is generally elliptical-like shaped. Besides, the two third connecting portions will be located at the corresponding positions on the first closed path T3'.

A longitudinally extended swing arm 270 is oriented behind the rear end of each linkage 260. The top ends of the two swing arms 270 are pivotally coupled to the two stand units 215 of the fixed unit 211 respectively. In details, the top end of each swing arm 270 is oriented between two fixed plates 215*d* and is pivotally coupled to the fixed plates 215*d*. Therefore, the top end of the swing arm 270 and even below the approximate two-thirds of the length of the swing arm 270 are oriented at the same vertical plane with the corresponding stand unit 215. No matter from the back side, the front side or the top side of the exercise apparatus 200, the top ends of two swing arms 270 can't be seen due to a part length of the swing arm 270 is surrounded by the corresponding stand unit 215. That is the top ends of two swing arms 270 are obscured by the rear bars 215*b* of the stand units 215, two front bars 215*a*, and two cross bars 215*c* respectively. The bottom of each swing arm 270 can be moved back and forth along a swing path T4' about a third axis A3'.

Additionally, the near top of each swing arm 270 is connected to an upward extended rocker 275. In details, the two rockers 275 extend toward an exercise space which is defined by the two stand units 215 and extend upward to the inner side of the two stand units 215, so that the top of each rocker 275 is higher than the third axis A3 and is formed as a handle 276 which can be griped by the user. The handles 276 also can be moved back and forth along a swaying path T5' about the third axis A3', and be moved opposite to the bottom end of the corresponding swing arm 270. As shown in FIGS. 14-15, the handles 276 are oriented at the front top of the third axis A3', so the front end of the swaying path T5' is lower than its rear end. When the user pushes the handle 276 toward, the force direction and the movement are toward and downward. On the contrary, when the user pulls the handle 276 back, the force direction and the movement are backward and upward.

The structures of two carrying arms 280, two pedals 282 and their connections with other elements are the same as the foregoing embodiment, so please referring to the described embodiment for details. Combining the movements of the second part of the carrying arm 280 which is moved along the first closed path T3' and the first part 281 which is moved along the swing path T4', the pedal 282 will be moved along a second closed path T6' which is generally elliptical-like shaped. The second closed path T6' shown in FIGS. 14-15 is the moving path of the middle part of the pedal 282.

The same with the described embodiment, the present embodiment can provide the sufficient pedal stroke under its smaller volume and shorter length to achieve the purpose of space saving. Meanwhile, the overall shape of the pedal path as well as the pedal dynamic motion are not only ergonomics conformed but also natural and comfortable for the user. Moreover, the user can control the position of the movable unit 212 of the frame 210 via the adjusting mechanism 220, so that he/she may have a different pedal movement path relative to the ground. Referring to FIGS. 14-15, the following are the further descriptions of the present embodiment:

The exercise apparatus 200 has the adjusting mechanism 220 which can locate the movable unit 212 of the frame between a first position (i.e. as shown in FIG. 14, two front pillars 214 are substantially perpendicular to the ground) and a second position (i.e. as shown in FIG. 15, a nut 222 is moved to the front end of a screw 223 and the two front pillars 214 are rotated along with the nut 222 to be located at about 81 degrees to the ground.) When the position of the movable unit 212 is changed, the track of the second closed path T6' is also changed with respect to the ground. In the user's point of view, the track changing of the second closed path T6' means the inclination changing and even its shape changing. In other words, when the user wants to change the exercising difficulty, he/she can achieve that goal not only by the resistance assembly (not shown) forcing the resistance to the flywheel 260, but by manipulating a console 217 to control the adjusting mechanism 220 to adjust the inclination of the second closed path T6'. That is, the movable unit 212 of the frame 210 can be located at a position which is within the range defined by the first position and the second position, thereby changing the second closed path T6' with respect to the ground to achieve the purpose of adjusting the exercising difficulty.

When the adjusting mechanism 220 starts operating, the movable unit 212 of the frame 210 starts rotated, the first axis A1' and the second axis A2' will be moved along with the fixed unit 211 until the movable unit 212 is located at a predetermined position which is set by the user. Regardless of the movable unit 212 is located at any position, the exercise apparatus 200 can still have the ergonomic features. The reason is that the displacement of the movable unit 212 will not change the relative positions of the first axis A1' and the second axis A2', the length of the crank unit 241, the length of the reciprocating member 250, the length between the first connecting portion 261 and the second connecting portion of the linkage 260. For instance, as shown in FIG. 15, during the movable unit 212 is moved from the first position to the second position, the first axis A1' and the second axis A2' will be rotated along with the front pillar 214. At the same time, the front pillar 214 is rotated about its bottom end so that the distance between the first axis A1' and the second axis A2' remains unchanged. As shown in FIG. 14, the first retracing point P1' and the second retracing point P2' define a straight line L' which is down through the circular path T1'. The better condition is that the straight line L' passes through the center of the circular path T1' so that the shape of the two halves of the first closed path T3' are more symmetrical and the shape of the second closed path T6' is still corresponding more symmetrical, too.

Comparing FIG. 14 and FIG. 15, when the movable unit 212 is oriented at the second position, the front end of the first closed path T3' is closer to the ground than it is in FIG. 14. In other words, the reason of the front end of the first closed path T3' is slightly lowered is that the first closed path T3' is formed by the relationship among the reciprocating members 250, the crank assembly 240 and the linkage 260, and those three elements are arranged on the movable unit 212 of the frame 210. When the movable unit 212 is rotated forward, the first closed path T3' will be rotated forward along with the bottom end of the front pillar 214. When the movable unit 212 is rotated from the vertical state to the tilting state, the front end of the first closed path T3' will go down and the rear end will go up surely. When the first closed path T3' is turned from FIG. 14 to FIG. 15, its specific effect can then see the front end of the right supporting arm 280 (which is pivotally connected to the right linkage 260), the first part 281 (which is pivotally connected to the right swing arm 270), and the relative relationship of the rear end (of the pedal 282) when the movable unit 212 is rotated. The right supporting arm 280 is a rigid body. When the front end of the right supporting arm 280 is close to the ground (i.e., the first closed path T3' shown in FIG. 15), like a seesaw, any part which is oriented behind the first part 281 of the right supporting arm 280 will be rotated as FIG. 15, and the middle part of the pedal 282 is no exception. As a result, the front end of the second closed path T6' in FIG. 15 is higher than in FIG. 14 and the slope of the second closed path T6' in FIG. 15 is also greater than in FIG. 14.

More particularly, in order to change the inclination of the second closed path T6', altering the positions of the first axis A1' and the second axis A2' is not the only way. In other possible embodiments, the crank shaft of the crank assembly (viewed as the first axis) can be arranged on the fixed unit of the frame and the shaft of the reciprocating member (viewed as the second axis) can be arranged on the movable unit. In the present embodiment, for example, the skilled person can easily arrange a cross bar (not shown) on the left and right stand units 215 corresponding to the first axis A1', and alter the first axis A1' from the movable unit 212 to the cross bar.

That is, the crank assembly 240 is arranged on the cross bar and the positions of the two reciprocating members 250 remain unchanged. Therefore, the inclination of the second closed path T6' can still be adjusted by changing the position of the reciprocating member 250. With different inclinations, the shape of the second closed path T6' will be changed slightly. As long as the adjustment is within a reasonable range, the foregoing amendments not depart from one of the spirit of the present invention: "When the adjusting mechanism 220 moves the movable unit 212 of the frame 210, the straight line L' defined by the two retracing points P1', P2' of the curved path T2' is down through the circular path T1' in the lateral view," and still able to maintain a certain degree of ergonomic advantages.

If only by changing the position of the second axis A2' to achieve the purpose of adjusting the exercise intensity, respect to the second embodiment of the present invention may not require such a relatively high bearing capacity of the structure like the front pillar 214. In order to save manufacturing costs, the designer may use a shorter rotating bar (not shown) to replace the front pillar 214 in other possible changes. For example, the length of the shorter rotating bar is only half of the front pillar, or even less. The bottom end of the rotating bar is pivotally connected to the fixing unit 211 of the frame 210 and its top end is similarly connected to the adjusting mechanism 220 for achieving the purpose of adjusting the position of the second axis.

Furthermore, in order to adjust the inclination of the second closed path T6', altering the positions of the first axis A1' and the second axis A2' is not the only way, there is a way by changing the position of the third axis A3'. About the adjustment of the third axis A3', please refer to U.S. Pat. No. 7,682,290, U.S. Pat. No. 7,744,508 or U.S. Pat. No. 7,976,435 which are applied by the applicant. As to how to apply those technologies to the present invention, a person has ordinary skill in the art to the field of exercising apparatuses should complete it without undue experimentations, so that the details are not narrated herein.

In the present embodiment, the adjusting mechanism 220 is electrical controlled, but the position of the movable unit 212 can be changed manually in other embodiments such as using a pin and a positioning hole. With some modifications of the related technologies of U.S. Pat. No. 7,654,936 or U.S. Pat. No. 7,846,071, then it can be applied in the present invention.

It should be added that the main advantages of the configuration of the handle 276 of the present embodiment are durable, remaining the current exercising space between two stand units 215, remaining the current occupied space of the exercise apparatus and achieving better ergonomics. In details, the handle 276 is moved along the swaying path T5' about a bearing which is the pivotal junction of the top end of the swing arm 270 and its corresponding stand unit 215. The two fixed plates 215*d* which are fixed at the stand unit 215 are pivotally coupled to the top end of the two swing arms 270 respectively. Under the situation of sharing the stress equally and symmetrically to the two fixed plates 215*d*, the structure of the present embodiment is stronger and more durable than the structure of U.S. Pat. No. 7,153,239. The bearing of the handle 276 is in the same vertical plane with the stand unit 215 but not at the inner side or the outer side of the stand unit 215 so that it will not affect the inner exercising space of the stand unit 215 or increase the outer occupied space. Additionally, referring to FIGS. 14-15, the front end of the second closed path T6' is in front of the third axis A3' in the lateral view. If the handles are directly arranged on the top ends of the corresponding swing arms (refer to U.S. Pat. No. 7,153,239) respectively, it will be surely just oriented on the both sides of the user's body respectively once the user step in the exercise apparatus and the situation like that is not conducive to the user's hands exercise. In this way, the handles of the present embodiment are arranged on the front top of the third axis A3'. Therefore, the user can grip the corresponding handle 276 to exercising smoothly and comfortably.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An exercise apparatus comprising:

a frame having a fixed unit and a movable unit being movable relative to the fixed unit;

an adjusting mechanism coupled to the frame for orienting the movable unit;

a crank assembly having a pair of crank units which are respectively and pivotally coupled to the frame about a first axis;

first and second reciprocating members respectively and pivotally coupled to the frame about a second axis;

first and second linkages, each linkage having a first, second and third connecting portions, the first connecting portions respectively and pivotally coupled to the crank units and moving along a circular path about the first axis, the second connecting portions respectively and pivotally coupled to the first and second reciprocating members and moving reciprocally between a first and second retracing points of a curved path about the second axis, the first retracing and the second retracing points defining a straight line passing through the circular path, the second connecting portions respectively being higher than the first connecting portions and the first retracing point being higher than the second retracing point of the curved path, the third connecting portions respectively being lower than the first connecting portions;

first and second swing arms, each swing arm having a top end and a bottom end, the top ends respectively and pivotally coupled to the frame about a third axis; and first and second supporting arms, each supporting arm having a first part, a second part and a third part, the first parts respectively and pivotally coupled to the bottom ends of the first and second swing arms, the second parts respectively arranged in front of the first parts and pivotally coupled to the third connecting portions of the first and second linkages for moving along a first closed path, the third parts respectively arranged behind the first parts for supporting a user's feet and moved along a second closed path;

wherein at least one of the first axis, the second axis and the third axis is mounted on the movable unit of the frame and at least one of distances among the first axis, the second axis and the third axis will be changed while the movable unit is moved by the adjusting mechanism whereby inclination of the second closed path relative to the ground will be changed when the movable unit is moving.

2. The exercise apparatus of claim 1, wherein the first and second reciprocating members are pivotally coupled to the movable unit of the frame.

3. The exercise apparatus of claim 2, wherein the two crank units of the crank assembly are pivotally coupled to the movable unit of the frame, and the distance between the first axis and the second axis is the same when the movable unit is moving.

4. The exercise apparatus of claim 1, wherein the straight line substantially passes through the center of the circular path.

5. The exercise apparatus of claim 1, wherein a distance between the first connecting portion and the second connecting portion of the first or second linkage is defined as an upper length, a distance between the first connecting portion and the third connecting portion of the first or second linkage is defined as an lower length in the lateral view, and the lower length is greater than the upper length and the length of the diameter of the circular path.

6. The exercise apparatus of claim 5, wherein the lower length is less than three times the length of the diameter of the circular path.

7. The exercise apparatus of claim 1, wherein the first retracing point of the curved path is oriented in an upper back of the second retracting point in the lateral view.

8. The exercise apparatus of claim 1, further comprising first and second rocking rods, one end of each rocking rod respectively coupled to predetermined positions of the first and second swing arms, the predetermined positions respectively oriented below the top ends of the first and second swing arm.

9. The exercise apparatus of claim 1, the adjusting mechanism further comprising a motor assembly, a screw and a nut, the motor assembly coupled to the fixed unit, one end of the screw pivotally coupled to the motor assembly, and the nut passed through by the screw and pivotally coupled to the movable unit.

* * * * *